United States Patent [19]

Klenk et al.

[11] 4,200,277

[45] Apr. 29, 1980

[54] FLAT PILE-AUTOMATIC SHEET FEEDER

[75] Inventors: Emil Klenk, Murrhardt; Adolf Hornung, Reichenberg, both of Fed. Rep. of Germany

[73] Assignee: Maschinenbau Oppenweiler GmbH, Oppenweiler, Fed. Rep. of Germany

[21] Appl. No.: 902,486

[22] Filed: May 3, 1978

[30] Foreign Application Priority Data

May 12, 1977 [DE] Fed. Rep. of Germany ..... 2721442

[51] Int. Cl.[2] ..... B65H 3/08

[52] U.S. Cl. ..... 271/90; 271/153; 271/154

[58] Field of Search ..... 271/30 R, 30 A, 31, 271/90, 103, 153, 154, 155

[56] References Cited

U.S. PATENT DOCUMENTS

| | | | |
|---|---|---|---|
| 2,840,270 | 6/1958 | Gore | 271/31 X |
| 3,448,978 | 6/1969 | Gibson | 271/31 X |

*Primary Examiner*—Richard A. Schacher
*Attorney, Agent, or Firm*—Martin A. Farber

[57] ABSTRACT

A flat pile - automatic sheet feeder for lifting sheets from a flat pile and feeding them further with a sheet separator which has at least one suction head at least one sensor and a shaft, which during the rotation moves and returns the suction head from a rest position which is lifted off the pile into a suction position lying on the flat pile and moves and returns the sensor from a sensing position lying on the flat pile into a release position swung out of the way from the flat pile, and with a removal device pulling-off the sheet which is lifted by the suction member. The shaft of the sheet separator is connected with a drive via a shifting clutch coupling, the drive being provided for a continuous operation, which coupling couples the shaft to the drive when no sheet is sucked on the suction head in its rest position and it decouples from the drive when the suction head with a sucked sheet occupies its rest position again, and that for switching of the coupling at least two signal generators are provided, of which the first signal generator indicates when the suction head is located in its rest position, and the second signal generator indicates when no sheet is sucked on the suction head.

10 Claims, 6 Drawing Figures

FLAT PILE-AUTOMATIC SHEET FEEDER

The invention relates to a flat pile - automatic sheet feeder for lifting sheets from a flat pile of sheets and feeding them further with a sheet separator which has at least one suction head, at least one sensor and a shaft, which during the rotation moves and returns the suction head, respectively, from and to a rest position which is lifted off a pile of sheets into a suction position lying on the pile and moves and returns the sensor from a sensing position lying on the pile into a release position swung out of the way from the pile, and with a removal or withdrawal device pulling-off the sheet which is lifted by the suction head.

From German Offenlegungsschrift OS No. 22 25 620, a sheet feeder of the above-mentioned type is known. With this known sheet feeder the shaft is continuously driven constantly by the main drive of the sheet feeder and with each rotation effects a working cycle of the suction head and of the sensor, so that the rotational speed of the constantly rotating shaft determines the working cycle of the sheet feeder. The disadvantage of this known sheet feeder resides in that here the rotational speed of the constantly rotating shaft of the sheet separator also fixes the cycle for the actuation of the pull-off and feeding devices, which devices convey further the sheets after the suction. This has the result that if a sheet is pulled off with delay by the removal or withdrawal device, it is overlapped with the following sheet, and consequently operating disturbances occur. In this manner the average output of the automatic sheet feeder is considerably impaired, so that one rather endures and puts up with larger spacings between the sheets, which prevents a full utilization of the output capability of the machine.

Sheet feeders indeed are known by which the suction head does not operate after a fixed prescribed cycle, but rather sucks and lifts a next sheet only when the preceeding sheet is pulled off. Sheet feeders of this type are known amongst others from German Offenlegungsschrift OS Nos. 20 33 564 and 25 22 017. With these known sheet feeders, for the suction of the sheet from the a pile, so-called spring suction heads are used, which suction heads are moveable by a pneumatic drive, which is operative by the suction vacuum which is produced and annihilated, respectively, with the suction or removal of a sheet. These known sheet feeders have the disadvantage that there the movement of the suction head and sensor only is dependent on the suction vacuum which is produced, so that these parts are moved independently of the running speed of the sheet feeder and their speed cannot be controlled independently of the suction vacuum.

The present invention is based on the task to produce a sheet feeder which in itself unites the advantages of both of the above-mentioned known devices and which consequently likewise as with the sheet feeder with the spring suction head only sucks a new sheet when the preceding sheet is pulled off from the suction member and by which the speed of the movement of the suction head and of the sensor can be controlled independently of the suction vacuum, so that difficult types of paper which must be fed anyhow with a reduced running speed, can be separated securely from the pile, also slower and with an adjusted suction vacuum.

This object is solved in accordance with the present invention with a sheet feeder of the introductory named type in the manner that the shaft (41) of the sheet separator (11) is connected with a drive (45) via a shifting clutch coupling (42), the drive (45) being provided for a continuous operation, which coupling (42) couples the shaft to the drive when no sheet is sucked on the suction head (32) in its rest position and it decouples from the drive when the suction head with a sucked sheet (14) occupies its rest position again, and that for switching of the coupling at least two signal generators (52, 52'; 53) are provided, of which the first signal generator (53) indicates when the suction head is located in its rest position, and the second signal generator (52, 52') indicates when no sheet is sucked on the suction head.

In this manner the possibility is provided to drive the shaft of the sheet separator from the main drive or from another controllable drive and thus to be able to adjust the movement speed of the suction head and of the sensor to the different types of paper. In the manner however that the shaft of the sheet separator is connected with the drive via a shifting coupling, which coupling couples the shaft to the drive when no sheet is sucked on the suction head in its rest position and it decouples from the drive when the suction head with a sucked sheeet again occupies its rest position, it is achieved that the shaft of the sheet separator always executes only one rotation for the downward and upward movement of the suction head and the next movement is started only when the sucked sheet is pulled off the suction head. The sheet separator with the sheet feeder according to the invention thus operates as well as a sheet separator with a spring suction head only in dependency on the sheet succession which is produced by means of pulling the sheets off from the suction head. If no sheet is sucked during a suction operation of the suction head then immediately the next follows the executed suction cycle, since the coupling is always switched on in the rest position of the suction head when no sheet is located on the suction head. Since the rotation time of the shaft of the sheet separator only constitutes a part of the time which is necessary for pulling off the sucked sheet, by this renewed suction operation the desired sheet succession is not impaired.

If the main drive of the sheet feeder is used as a drive for the shaft of the sheet separator, then likewise as with the sheet feeder with a continually rotating shaft of the sheet separator, there results automatically a movement speed of the suction head and of the sensor which is proportional to the sheet feeding speed, without a working cycle thereby being prescribed by this drive.

As a drive for the shaft of the sheet separator, also a variable speed motor can be provided, which permits all possible adjustments. This variable speed motor with its control can also be electrically coupled with the control of the main drive in a desired manner.

By the two signal generators or transmitters, there is achieved a non-objectionable control of the coupling, dependent on the position of the suction head, and thereon, if a sheet is sucked or is not sucked on the suction head, and therewith, of the movement of the suction head and of the sensor. The first signal transmitter in this manner can be actuated by a part moving synchronously with the suction head, for example directly by the shaft of the sheet separator. As a second signal transmitter, photoelectric indicator means can be provided, for example light gates, or a vacuum switch, which responds to the vacuum brought about in the suction head by the sucked sheet.

With the above and other objects and advantages in view, the present invention will become more clearly understood in connection with the following detailed description of preferred embodiments of the invention, when considered with the accompanying drawings, of which:

Figure 1:
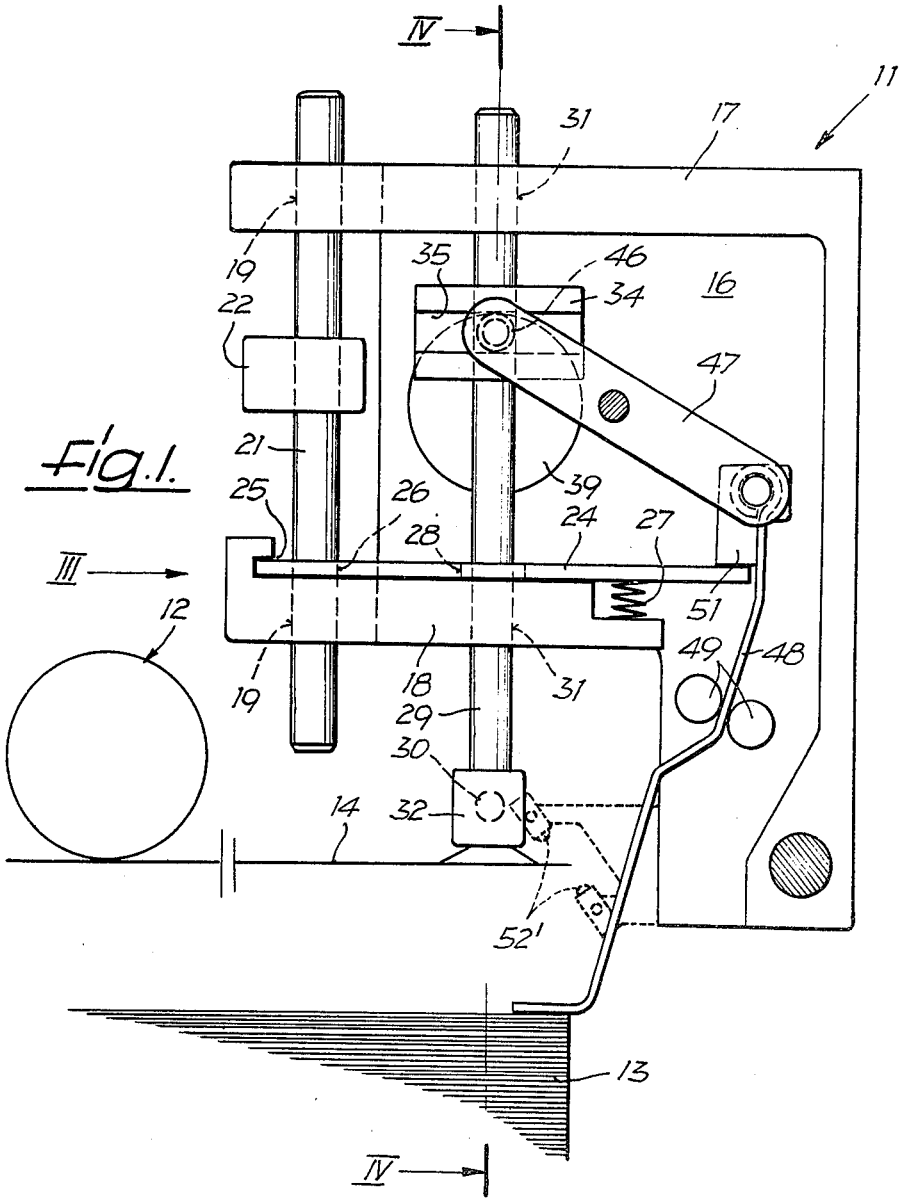
FIGS. 1 and 2 are side views of the embodiment by which the side plate which faces the viewer is omitted and the suction head is shown in its rest- and suction-position, respectively.

The sheet feeder illustrated in the drawings has a sheet separator designated as a unit with the numeral 11 and a withdrawal or removal device 12 for pulling off the uppermost sheet 14 lifted from a flat stack or pile 13, the withdrawal device 12 being contructed as a suction wheel. The withdrawal device 12 is formed in a known manner and consequently is not described in further detail.

Figure 2:
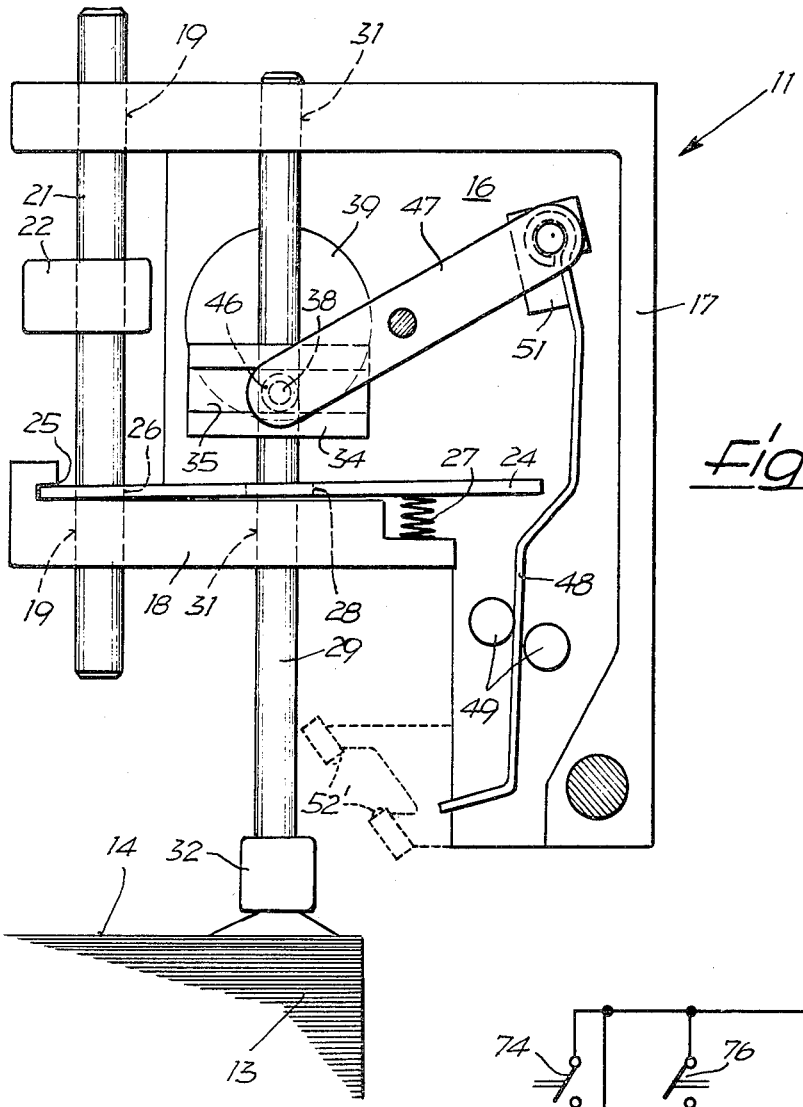

The housing of the sheet separator 11 has two side plates 16, which are secured on an angle member 17 forming an upper and a rear wall and are secured to a beam 18 forming a lower wall. The horizontal leg of the angle 17 and the beam 18 have vertical bores 19 which are aligned with one another. A vertical guide rod 21 engages in the bores 19. The guide rod 21 is secured to an arm 22, which arm is connected horizontally adjustably in the plane of the drawing of FIGS. 1 and 2, thus in the feed direction of the withdrawal device, with the support of the sheet feeder (which support is not illustrated in the drawings), in order to be able to adjust the position of the sheet separator 11 to the length (measured in the feed direction) of the sheets of the flat stack 13, which sheets are to be singled or separated. One end of a tension spring 23 (FIG. 3) is secured on this arm 22, the other end of the spring acting on one of the side plates 16 in order to equalize the weight of the sheet separator 11 to a small remainder. A clamping strip 24 is arranged on the beam 18, which clamping strip on its edge engages in a groove 25 formed by the beam 18. The clamping strip 24 is formed with a bore 26 for the guide rod 21. The diameter of the bore 26 is narrowly or tightly adjusted to the diameter of the guide rod 21 such that a small pivotal movement of the clamping strip 24 is effected upwardly about the groove 25 (which is formed to permit same), such that the clamping strip is rigidly clamped on the guide rod 21 and in this manner the sheet separator 11 is held fixed on the guide rod 21. In order to cause this clamping action, between the beam 18 and the clamping strip 24 there is provided a compression spring 27 which presses the right end of the clamping strip 24 upwardly as indicated in FIG. 2, the right end being shown in both FIGS. 1 and 2.

In the clamping strip 24, an additional bore 28 is provided in which a vertical rod 29 engages with play, which allows the movement of the clamping strip 24 that is necessary for producing the clamping action of the clamping strip 24 without thereby clamping the rod 29. This rod 29 is vertically guided in bores 31 of the upper leg of the angle member 17 and of the beam 18, which bores 31 are aligned with each other. The lower end of the rod 29 is connected with a rod 30 which extends transversely to the feeding direction of the removal device 12, which rod 30 on each of its two ends, respectively carries a suction band 32. These suction heads 32 are connected via lines 33 with a vacuum source (not illustrated in the drawings).

A connecting link 34 is fastened on the vertical rod 29, which connecting link on both sides has a horizontal guide groove 35 and 36, respectively. A roller 37 engages in the guide groove 36, which roller is rotatably mounted on a crank pin 38 which is fastened on a crank disc 39 (FIG. 4).

Figure 3:
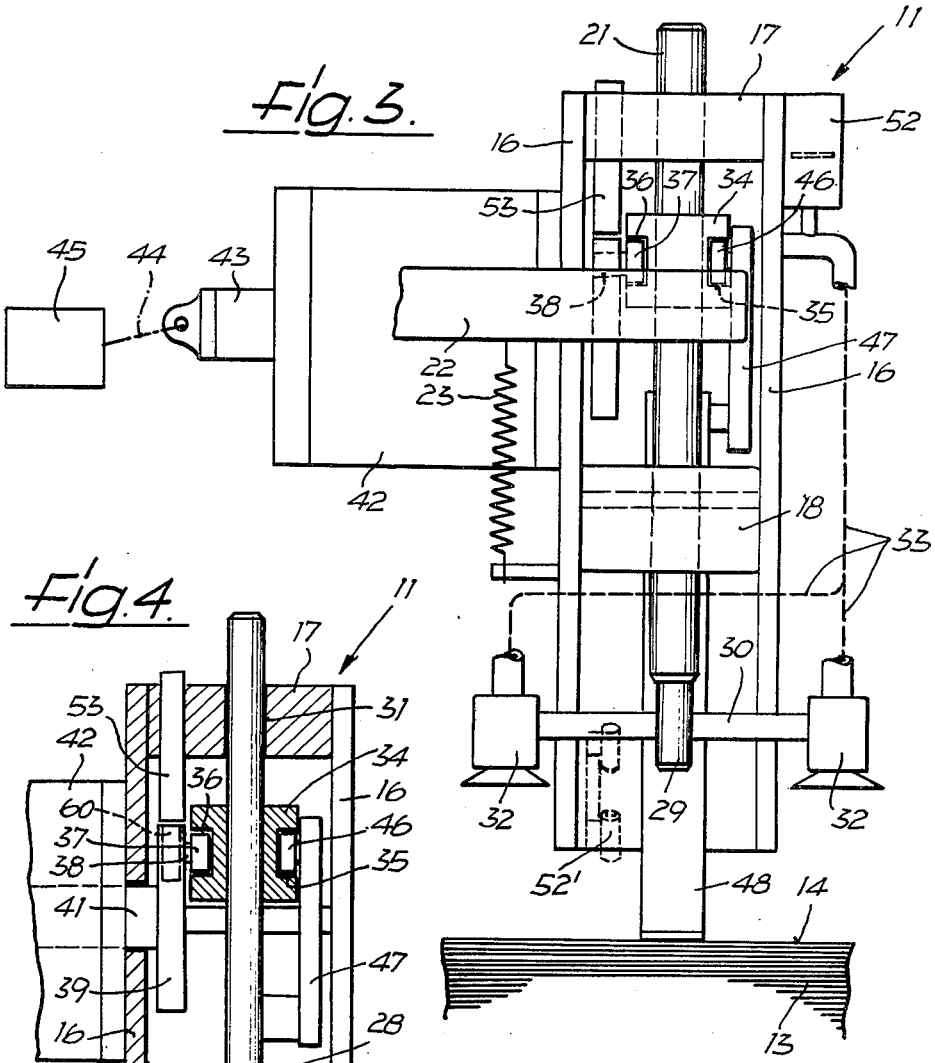
FIGS. 3 and 4 is a view in the direction of the arrow III and a section along line IV—IV of FIG. 1, respectively.
Figure 4:
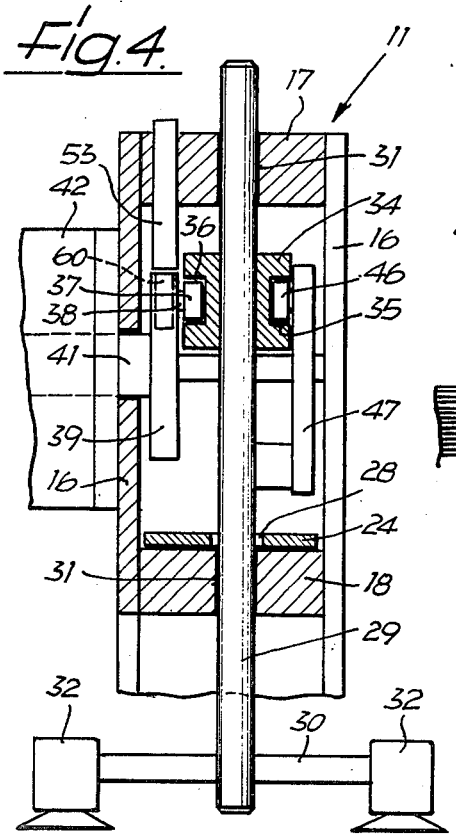
Figure 5:
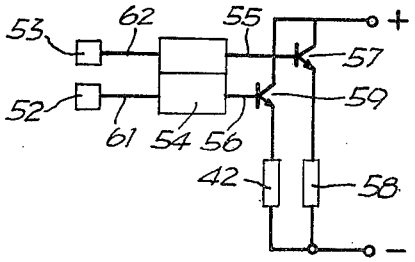

As is evident from FIG. 4, the crank disc 39 is fastened on the end of the drive-off side or driven shaft 41 of a shifting coupling or clutch 42, which end of the shaft 41 projects through a bore in the adjacent side plate 16. The drive side shaft 43 (FIG. 3) of the shifting coupling 42 is articulated with a drive 45 by means of a shaft 44. This drive 45 can be the main drive of the sheet feeder. Also however a controllable special drive 45 can be provided.

A roller 46 engages in the other guide groove 35 of the connecting link 34, which roller 46 is rotatably mounted on one of the ends of a double-armed lever 47. On the other end of the lever 47 there is articulated a feeler or sensor 48, the latter being guided between two rollers 49 which are rotatably mounted between the side walls 16 such that in the release of disengaging position swung out of the way from the flat pile illustrated in FIG. 2, it frees or opens the space for lifting of the uppermost sheet 14 of the flat pile 13, which uppermost sheet 14 is sucked by the suction boxes 32, and in its sensing position lying on the flat pile illustrated in FIG. 1, it supports the sheet separator 11 on the flat pile 13. So that the sheet separator 11 can always be adjusted or set by the sensor in the correct position to the flat pile 13, on the sensor 48 there is provided a shoulder or abutment 51, which shoulder in the sensing position of the sensor 48 illustrated in FIG. 1, presses the end of the clamping strip 24 (which end stands under the action of the compression spring 27) against the force of the spring 27 downwardly into a position in which the clamping strip 24 is no longer rigidly clamped on the guide rod 21.

As illustrated in FIG. 3, the suction lines 33 are connected with a signal generator or transmitter 52 formed as a vacuum switch, which emits a signal by the collapsing of the vacuum in the vacuum lines 33. This signal indicates that no sheet is sucked on the suction head 32. A further signal transmitter 53 is formed by a magnetic switch, also called a reed switch, which emits a signal when a permanent magnet 60, the latter being arranged in a radial bore of the crank disc 39, is located directly adjacent the magnetic switch, so that the latter switches and thereby indicates that the suction head 32 is found in the lifted rest position illustrated in FIG. 1.

For switching the shifting clutch coupling 42, a R-S flip-flop (reset-set) 54 can be provided with two push-pull outputs 55 and 56. One output 55 of the flip-flop 54 is connected with the base of a transistor 57. Upon a signal coming via the output 55, the transistor 57 switches on a brake 58 for braking of the driven-side shaft 41, which brake 58 is provided in the shifting clutch coupling 42. The other output 56 of the flip-flop 54 is connected with the base of a transistor 59, which transistor switches on the shifting clutch coupling 42 on a signal arriving through the output 56 and therewith connects both shafts 41 and 43 with each other. One of the inputs 62 of the flip-flop 54 is connected with the signal generator 53, the latter being formed by the magnetic switch. The other input 61 is connected with the signal generator or transmitter 52, which signal generator 52 is formed by the vacuum switch. The input 61 has priority before the input 62.

The above-described flat piling - sheet feeder has the following manner of operation. As soon as a sucked and lifted sheet 14 during the rest position (illustrated in FIG. 1) of the suction heads 32 is pulled off from the suction head 32 by the removal device 12, the vacuum collapses in the suction lines 33, so that the signal generator 52 which is formed by the vacuum switch emits a signal to the flip-flop 54 via the input 61, which flip-flop 54 thereby switches the transistors 57 and 59 such that the brake 58 is released and the clutch coupling 42 is switched on. This has the result that immediately after the removal of the sheet 14, the shaft 41 is operatively coupled with the drive 45 and the connecting link 34 is moved downwardly out of the position illustrated in FIG. 1. In this manner the sensor 48 is moved from its sensing or touching position illustrated in FIG. 1 into the release or open position illustrated in FIG. 2 and again returned and the suction heads 32 are moved from the rest position illustrated in FIG. 1 into the suction position illustrated in FIG. 2 and again returned. In the suction position, the suction heads 32 suck a sheet 14. As soon as they have again reached their elevated rest position, the generator 53 which is formed by the magnetic switch is switched and emits a signal that the suction devices 32 are located in the rest position. This signal is fed via the input 62 to the flip-flop 54, so that the latter is reversed or flipped-over such that the clutch coupling 42 is switched off and the brake 58 is switched on. After the removal of the uppermost sheet 14 from the suction devices 32, the same operation is repeated.

If with such an operation, a sheet is not sucked, then upon reaching the uppermost position of the suction heads 32, the coupling 42 is not switched off, since the input 61, which indicates that the suction heads have not sucked a sheet, has priority. The suction heads 32 thus immediately again move into the suction position further in order to suck the next sheet.

Figure 6:
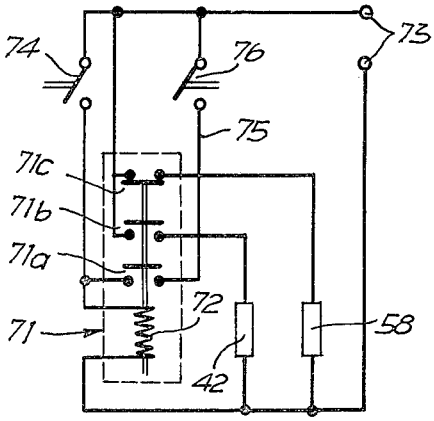
FIGS. 5 and 6 are circuit diagrams of two embodiments for the control of the coupling and of the brake for the shaft of the sheet separator.

Instead of the flip-flop circuit or switching, also the relay switching circuitry illustrated in FIG. 6 can be provided. This circuitry has a relay 71, which is provided with three switching members 71*a*, 71*b* and 71*c*. The winding 72 of the relay 71 is connected via terminals 73 and a switch 74 with a source of current. The switch 74 is closed by the signal of the signal generator 52, the latter being formed by the vacuum switch and is opened when by the suction of a sheet, a vacuum is formed in the suction lines 33. The switching member 71*a* serves as a holding member which is closed during the excitation of the winding 72. The switching members 71*b* and 71*c* serve for switching-on and switching-off the coupling 42 and the brake 58, respectively, when the winding 72 of the relay is excited. In the holding line 75, a switch 76 is provided, which switch is opened when the signal generator 53 (which is formed by the magnetic switch) indicates that the suction devices 32 are found with a sucked sheet in their rest position, and which otherwise is closed. As long as the suction devices 32 are found in their rest position with a sucked sheet 14, both switches 74 and 76 are opened, so that the winding 72 is deenergized and in this manner the brake 58 is switched on and the shifting clutch coupling 42 is switched off. As soon as the sheet 14 is drawn off from the suction head 32, the vacuum in the lines 33 collapses so that the signal generator 52 emits a signal by which the switch 74 is closed. In this manner the connecting link 34 is set into movement so that the switch 76 is closed. As soon as a sheet is sucked by the suction heads 32. The vacuum in the suction lines 33 again develops so that the switch 74 opens. The winding 72 however remains excited since the switching member 71*a* and the switch 76 in the holding line 75 are closed. As soon as the suction heads 32 have now reached their rest position, by the signal of the signal generator 53, the switch 76 is opened so that no longer is the winding 72 fed and the relay 71 deenergizes, which has the consequence that the brake 58 is switched on and the coupling 42 is switched off. After the removal of the sucked sheet, the same operation is repeated.

With the above-described embodiment the signal transmitter 52 which is formed by the vacuum switch indicates when a sheet is sucked on the suction members 32. With an alternate embodiment, instead of the vacuum switch, a signal generator 52' which is formed by means of a light gate and which is illustrated in dashed lines in the drawing is provided. With this light gate, the light beam is interrupted by the rear edge of a sucked sheet when the suction members 32 are found in the rest position. The manner of operation of the device with a signal generator 52' formed by a light gate is the same as with a signal generator 52 formed by a vacuum switch.

We claim:

1. In an automatic sheet feeder for lifting sheets from a flat pile of sheets and feeding them further with a sheet separator which has at least one suction head, at least one sensor and a shaft, which during the rotation moves and returns the suction head from a rest position which is lifted off the pile into a suction position lying on the flat pile and moves and returns the sensor from a sensing position lying on the flat pile into a release position swung out of the way of the sheet lifted from the flat pile, and with a removal device pulling-off the sheet which is lifted by the suction head, the improvement comprising a sheet separator having a shaft, a drive means for a continuous operation, a shifting coupling said shaft onto said drive means when no sheet is sucked on the suction head in its rest position and for decoupling from said drive means when said suction head with sucked sheet occupies its rest position again, at least two signal generators for switching said coupling.

a first of said signal generators constituting means for indicating when the suction head is located in its rest position, a second of said signal generators constituting means for showing when no sheet is sucked on the suction head.

2. The sheet feeder according to claim 1, further comprising a brake operatively connected to said shaft of said sheet separator, said brake is alternately switchable with said shifting coupling.

3. The sheet feeder according to claim 1 or 2, wherein said signal generators have electrical switching members, at least one switching member of said first signal generator is switchable by a part moving synchronously with the suction head and at least one switching member of said second signal generator is switchable by means of a sheet sucked on the suction head.

4. The sheet feeder according to claim 3, further comprising a vacuum switch constituting the switching member of said second signal generator, said vacuum switch is switchable by the vacuum developing in the suction head by the sucking of a sheet.

5. The sheet feeder according to claim 3, wherein the switching member of said second signal generator has a sensing means for sensing the sheet sucked on the suction head.

6. The sheet feeder according to claim 3, further comprising a relay means for switching said switching members, said relay means for switching said shifting coupling.

7. The sheet feeder according to claim 3, further comprising a flip-flop means for being controlled by said switching members, said flip-flop means for switching said shifting coupling.

8. The sheet feeder according to claim 1, wherein the shaft of said sheet separator for the drive of the suction head has a crank means cooperating with the latter, and lever means connecting the suction head with the sensor for a counter running movement.

9. The sheet feeder according to claim 1, further comprising a clamping means for being switchable by the shaft of the sheet separator, the latter being freely moveably mounted down and up and supported on the flat pile via the sensor, said clamping means for holding said sheet separator in its height position determined by the sensor, while the sensor is swung out of the way from its sensing position.

10. In an automatic sheet feeder for lifting sheets from a flat pile of sheets and feeding them further with a sheet separator which has at least one suction means, at least one sensor and a shaft means, the shaft means during rotation moving and returning the suction means from a rest position which is lifted off the pile into a suction position lying on the flat pile and moves and returns the sensor from a sensing position lying on the flat pile into a release position swung out of the way of the sheet lifted from the flat pile, and with a removal device pulling-off the sheet which is lifted by the suction means, the improvement comprising a continuously operating means for rotating the shaft means when operatively coupled therewith, means for operatively coupling the shaft means to said continuously operating means when no sheet is sucked on the suction means in the rest position until, and for decoupling the shaft means from said continuously operating means only when, said suction means with a sucked sheet thereon occupies the rest position again.

* * * * *